US007240591B2

(12) United States Patent
Hsien

(10) Patent No.: US 7,240,591 B2
(45) Date of Patent: Jul. 10, 2007

(54) ADJUSTABLE SPANNER

(76) Inventor: Chih-Ching Hsien, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/684,153

(22) Filed: Oct. 9, 2003

(65) Prior Publication Data

US 2005/0076747 A1 Apr. 14, 2005

(51) Int. Cl.
*B25B 13/16* (2006.01)

(52) U.S. Cl. ..... 81/165; 81/170

(58) Field of Classification Search ..... 81/170, 81/165, 155, 166, 167, 133
See application file for complete search history.

(56) References Cited

U.S. PATENT DOCUMENTS 2,722,150 A * 11/1955 Green ..... 81/165
5,331,868 A * 7/1994 Elmore ..... 81/165
6,116,121 A * 9/2000 Kitt, Jr. ..... 81/170
6,382,056 B1 * 5/2002 Wu ..... 81/165
6,666,114 B1 * 12/2003 Lin ..... 81/438

* cited by examiner

*Primary Examiner*—Jacob K. Ackun, Jr.

(57) ABSTRACT

A adjustable spanner includes a main body formed with a fixed jaw and a slideway, an adjustment screw rotatably mounted in the main body, a movable jaw movably mounted on the main body and formed with a neck portion having a rack slidably mounted in the slideway and engaged with the adjustment screw, and two magnetic members mounted between the slideway and the movable jaw. Thus, the movable jaw is movable in the slideway smoothly by the repulsive effect between the magnetic members and the movable jaw or the main body, thereby facilitating the user operating the adjustable spanner.

11 Claims, 6 Drawing Sheets

ADJUSTABLE SPANNER

BACKGROUND OF THE INVENTION

1. Field of the Invention

The present invention relates to an adjustable spanner, and more particularly to an adjustable spanner, wherein the movable jaw is movable in the slideway of the main body smoothly and stably, thereby facilitating the user operating the adjustable spanner.

2. Description of the Related Art

A conventional adjustable spanner comprises a main body having a first end formed with a handle portion and a second end formed with a drive portion having a fixed jaw and a slideway, an adjustment screw rotatably mounted in the main body, and a movable jaw movably mounted on the drive portion and having a bottom formed with a rack slidably mounted in the slideway and engaged with the adjustment screw. Thus, the rack is moved by rotation of the adjustment screw, so that the movable jaw is moved relative to the fixed jaw. Thus, the user's one hand can hold the handle portion to rotate the drive portion so as to rotate a screw member on a workpiece.

Usually, a clearance is defined between the movable jaw and the slideway of the fixed jaw. However, the movable jaw easily lean rightward and leftward due to the torque produced by the weight of the movable jaw, so that one side of the movable jaw is rested on the slideway of the fixed jaw. Thus, the movable jaw successively rubs the slideway of the fixed jaw during movement of the movable jaw, so that the movable jaw and the slideway of the fixed jaw are easily worn out due to friction, and the movable jaw cannot move smoothly.

SUMMARY OF THE INVENTION

The primary objective of the present invention is to provide an adjustable spanner, wherein the movable jaw is movable in the slideway of the main body smoothly and stably by the repulsive effect between the two magnetic members and the movable jaw or the main body, thereby facilitating the user operating the adjustable spanner.

Another objective of the present invention is to provide an adjustable spanner, wherein the two magnetic members are mounted in the main body or the movable jaw in a bonding or close fit manner, thereby preventing from detachment of the magnetic members during operation.

A further objective of the present invention is to provide an adjustable spanner, wherein each of the two magnetic members is made of a rigid material, so that the two magnetic members are mounted in the main body or the movable jaw easily and conveniently.

A further objective of the present invention is to provide an adjustable spanner, wherein each of the two magnetic members is flush with the neck portion of the movable jaw or the respective side wall of the slideway of the main body, so that each of the two magnetic members will not be worn during movement of the movable jaw.

In accordance with the present invention, there is provided an adjustable spanner, comprising a main body having an end formed with a fixed jaw and a slideway located adjacent to the fixed jaw, an adjustment screw rotatably mounted in the main body, and a movable jaw movably mounted on the main body and having an end formed with a neck portion having a bottom formed with a rack slidably mounted in the slideway of the main body and engaged with the adjustment screw, wherein:

the adjustable spanner further comprises two magnetic members mounted between the slideway of the main body and the movable jaw.

Further benefits and advantages of the present invention will become apparent after a careful reading of the detailed description with appropriate reference to the accompanying drawings.

DETAILED DESCRIPTION OF THE INVENTION

Figure 1:
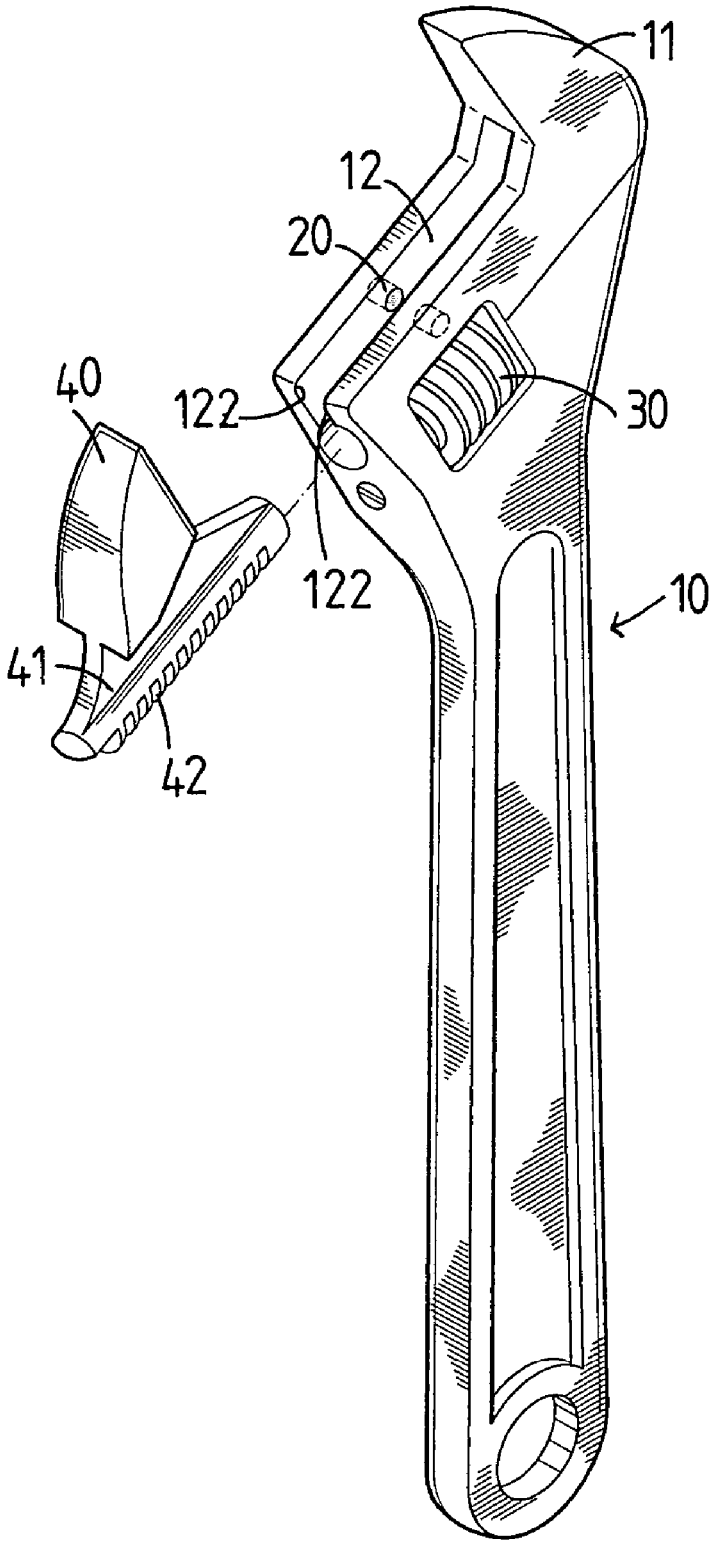
FIG. 1 is an exploded perspective view of an adjustable spanner in accordance with the preferred embodiment of the present invention.
Figure 2:
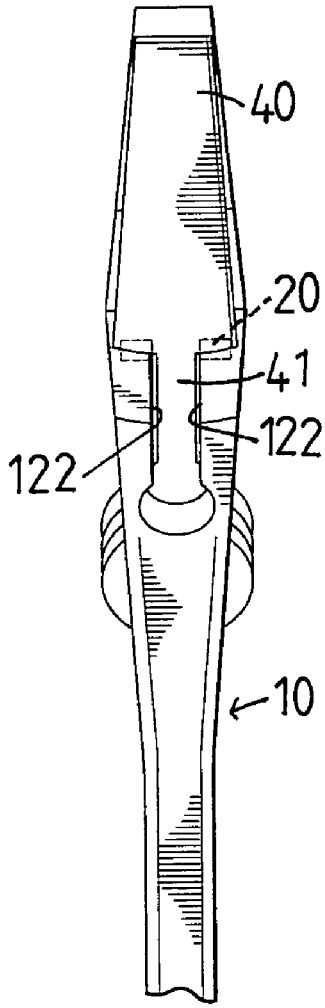
FIG. 2 is a partially cut-away side plan assembly view of the adjustable spanner as shown in FIG. 1.
Figure 3:
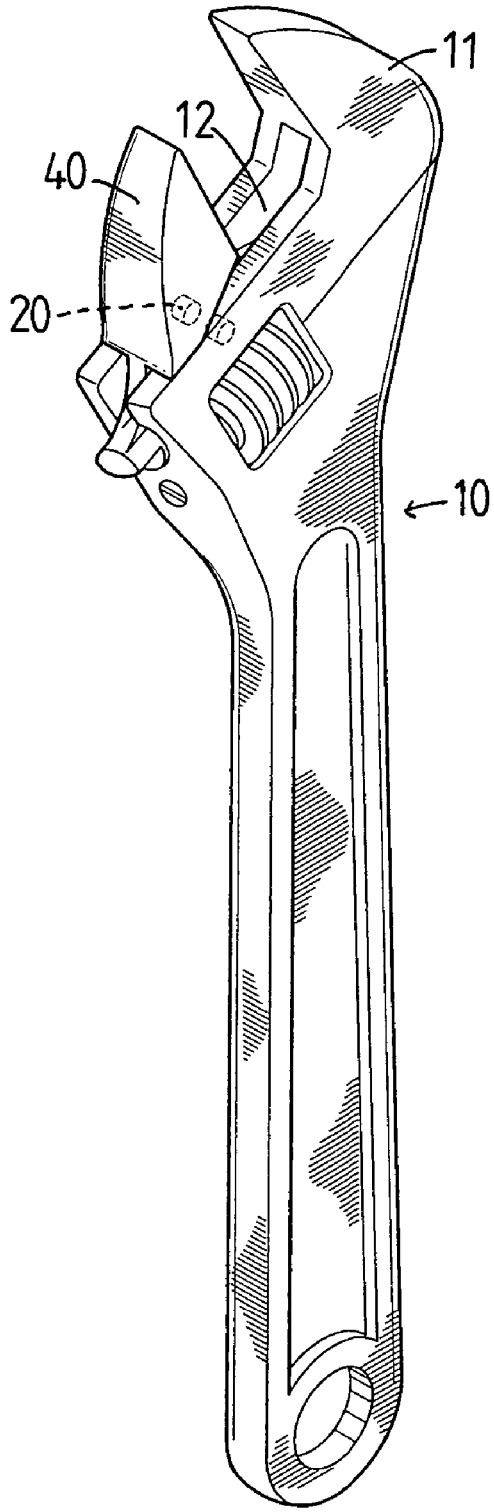
FIG. 3 is a perspective assembly view of the adjustable spanner as shown in FIG. 1.

Referring to the drawings and initially to FIGS. 1–3, an adjustable spanner in accordance with the preferred embodiment of the present invention comprises a main body 10 having an end formed with a fixed jaw 11 and a transverse slideway 12 located adjacent to the fixed jaw 11, an adjustment screw 30 rotatably mounted in the main body 10, and a movable jaw 40 movably mounted on the main body 10 and having an end formed with a neck portion 41 having a bottom formed with a rack 42 slidably mounted in the slideway 12 of the main body 10 and engaged with the adjustment screw 30. Thus, the rack 42 is moved by rotation of the adjustment screw 30, so that the movable jaw 40 is moved relative to the fixed jaw 11.

The slideway 12 of the main body 10 has two opposite side walls 122. The neck portion 41 of the movable jaw 40 is slidably mounted in the slideway 12 of the main body 10 and located between the two opposite side walls 122 of the slideway 12 of the main body 10.

The adjustable spanner further comprises two magnetic members 20 each mounted in a respective one of the two opposite side walls 122 of the slideway 12 of the main body 10 in a bonding or close fit manner, thereby preventing from detachment of the magnetic members 20 during operation.

The ends of the two magnetic members 20 having the same polarity are located opposite to each other, so that when the movable jaw 40 is mounted in the slideway 12 of the main body 10, the two magnetic members 20 apply a repulsion force on the movable jaw 40. Thus, the neck portion 41 and the rack 42 of the movable jaw 40 are movable in the slideway 12 of the main body 10 smoothly and conveniently without obstruction.

Thus, the movable jaw 40 is maintained at the center of the slideway 12 of the main body 10 by the repulsive effect between the two magnetic members 20 and the movable jaw 40 without leaning on either one of the two opposite side walls 122 of the slideway 12 of the main body 10, so that the movable jaw 40 is movable in the slideway 12 of the main body 10 smoothly and conveniently.

Figure 4:
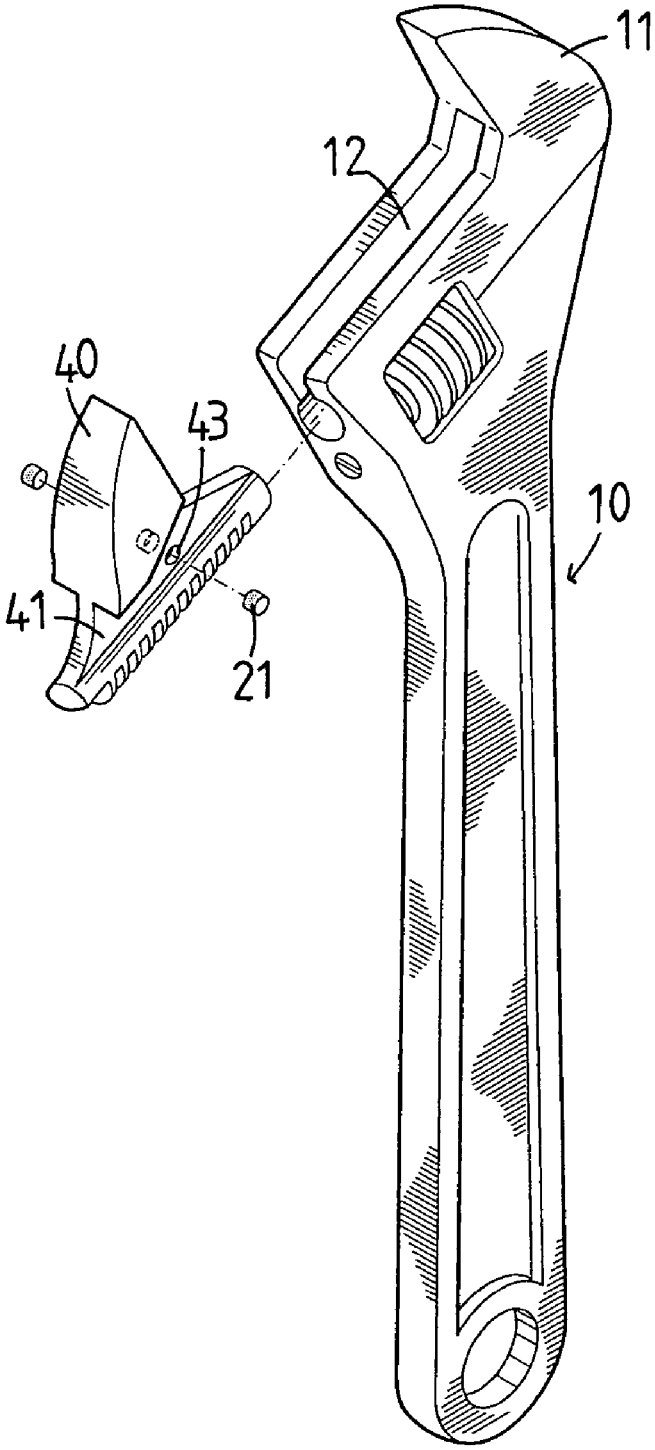
FIG. 4 is an exploded perspective view of an adjustable spanner in accordance with another embodiment of the present invention.
Figure 5:
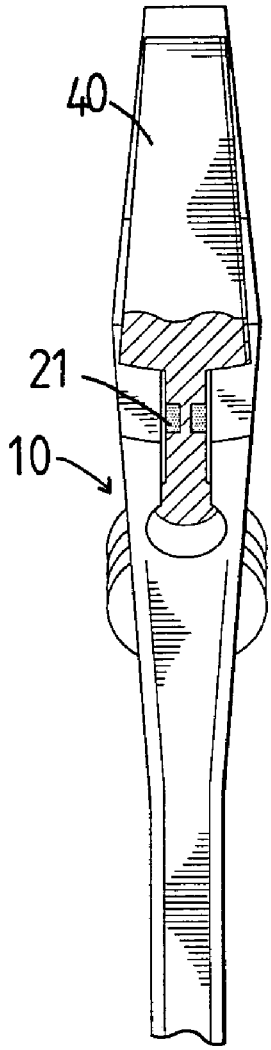
FIG. 5 is a partially cut-away side plan cross-sectional assembly view of the adjustable spanner as shown in FIG. 4.

Referring to FIGS. 4 and 5, an adjustable spanner in accordance with another embodiment of the present invention is shown, wherein the neck portion 41 of the movable jaw 40 has two sides each formed with a recess 43 for mounting a respective one of the two magnetic members 21. In addition, each of the two magnetic members 21 has a circular shape, and the recess 43 of the neck portion 41 of the movable jaw 40 has a circular shape.

Figure 6:
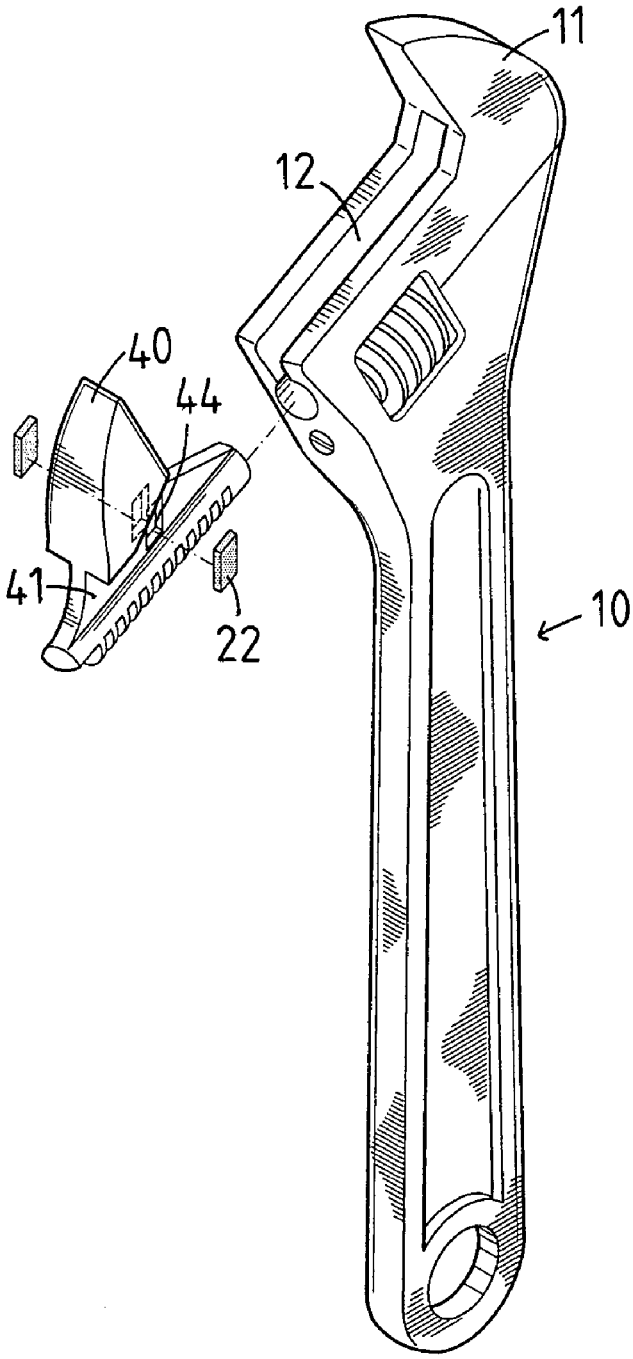
FIG. 6 is an exploded perspective view of an adjustable spanner in accordance with another embodiment of the present invention.
Figure 7:
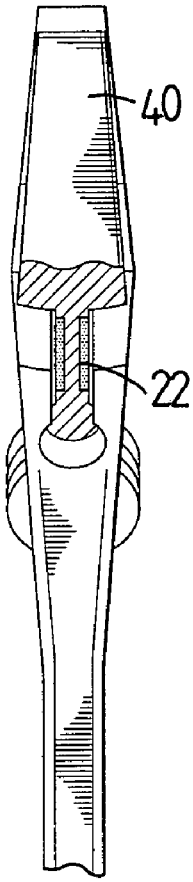
FIG. 7 is a partially cut-away side plan cross-sectional assembly view of the adjustable spanner as shown in FIG. 6.

Referring to FIGS. 6 and 7, an adjustable spanner in accordance with another embodiment of the present invention is shown, wherein each of the two magnetic members 22 has a rectangular shape, and the recess 44 of the neck portion 41 of the movable jaw 40 has a rectangular shape.

Figure 8:
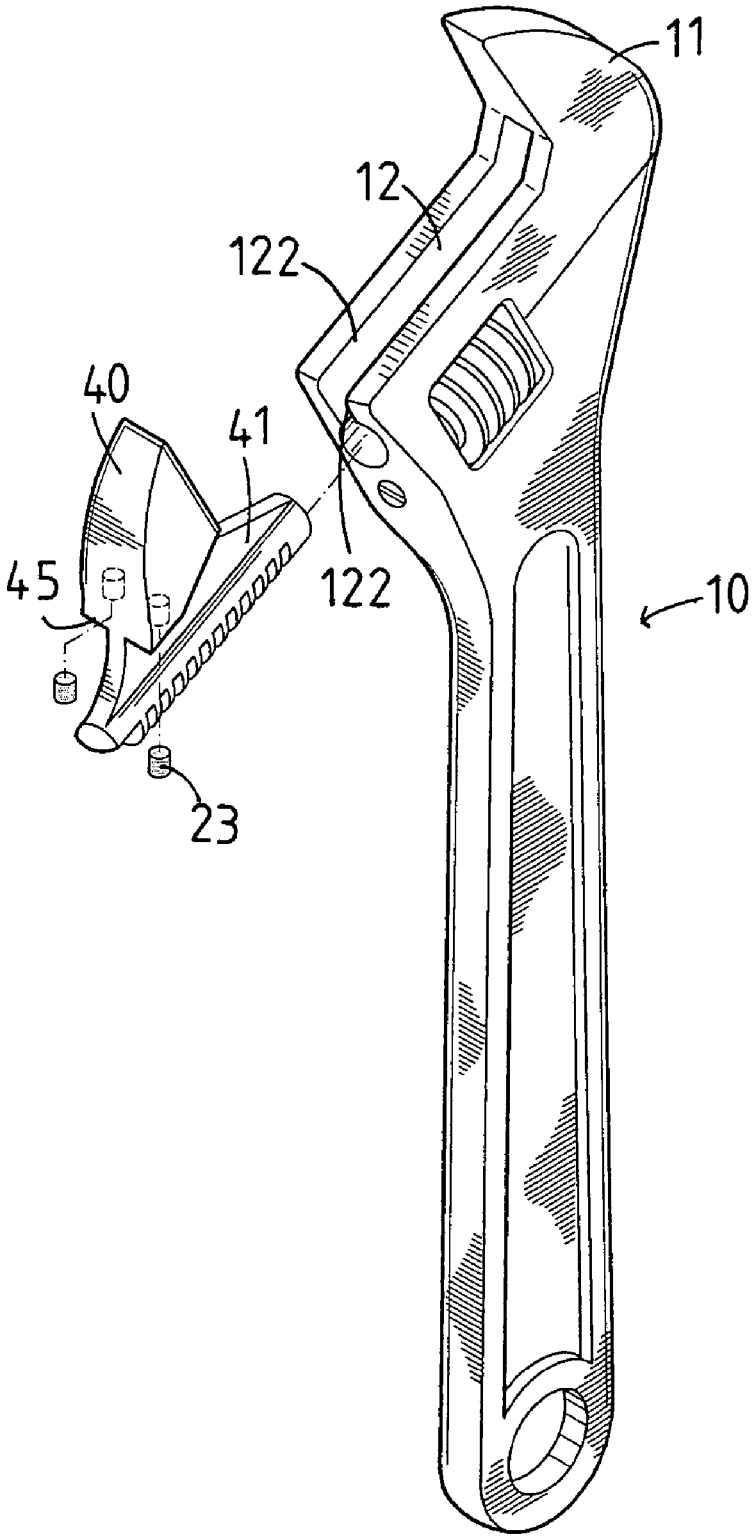
FIG. 8 is an exploded perspective view of an adjustable spanner in accordance with another embodiment of the present invention.
Figure 9:
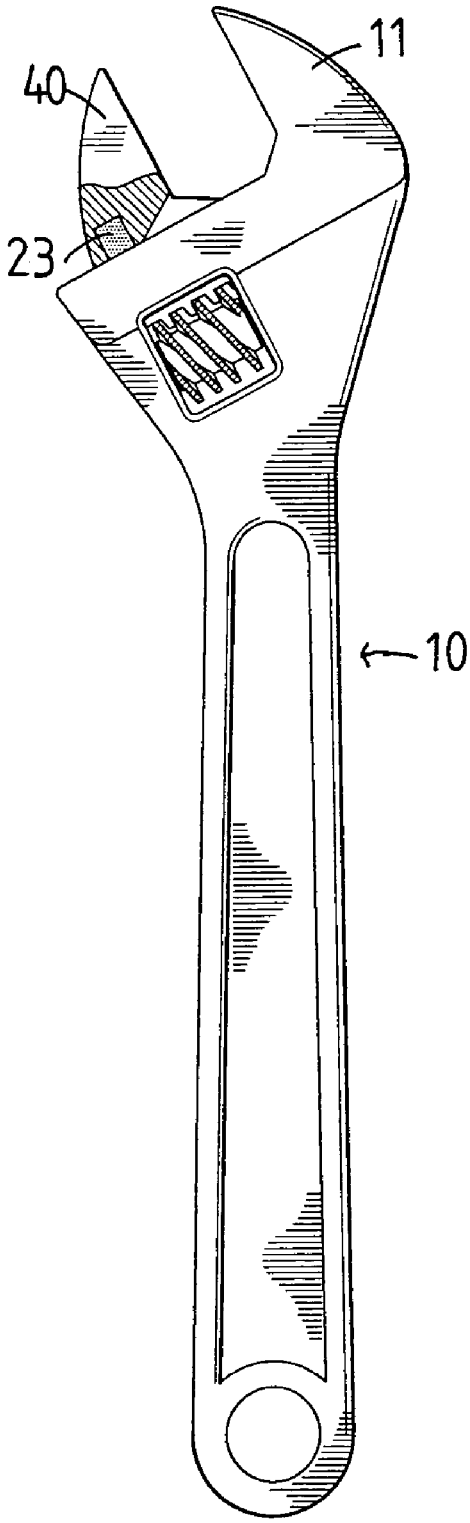
FIG. 9 is a partially plan cross-sectional assembly view of the adjustable spanner as shown in FIG. 8.

Referring to FIGS. 8 and 9, an adjustable spanner in accordance with another embodiment of the present invention is shown, wherein the movable jaw 40 has two sides each formed with a shoulder 45 for mounting a respective one of the two magnetic members 23. In addition, the shoulder 45 of the movable jaw 40 is located above the neck portion 41 and located above each of the two opposite side walls 122 of the slideway 12 of the main body 10.

The ends of the two magnetic members 23 having the same polarity are located opposite to each other, so that when the movable jaw 40 is mounted in the slideway 12 of the main body 10, the two magnetic members 23 apply a repulsion force on the main body 10. Thus, the movable jaw 40 is movable in the slideway 12 of the main body 10 smoothly and conveniently without obstruction.

In conclusion, the two magnetic members 20 are mounted in the main body 10 or the movable jaw 40, and the ends of the two magnetic members 23 having the same polarity are located opposite to each other. Thus, the movable jaw 40 is maintained at the center of the slideway 12 of the main body 10 by the repulsive effect between the two magnetic members 20 and the movable jaw 40 or the main body 10 without leaning on either one of the two opposite side walls 122 of the slideway 12 of the main body 10, so that the movable jaw 40 is movable in the slideway 12 of the main body 10 smoothly and stably.

Accordingly, the two magnetic members 20 are mounted in the main body 10 or the movable jaw 40 in a bonding or close fit manner, thereby preventing from detachment of the magnetic members 20 during operation. In addition, each of the two magnetic members 20 is made of a rigid material, so that the two magnetic members 20 are mounted in the main body 10 or the movable jaw 40 easily and conveniently. Further, each of the two magnetic members 21 is flush with the neck portion 41 of the movable jaw 40 or the respective side wall 122 of the slideway 12 of the main body 10, so that each of the two magnetic members 21 will not be worn during movement of the movable jaw 40.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An adjustable spanner, comprising a main body having an end formed with a fixed jaw and a slideway located adjacent to the fixed jaw, an adjustment screw rotatably mounted in the main body, and a movable jaw movably mounted on the main body and having an end formed with a neck portion having a bottom formed with a rack slidably mounted in the slideway of the main body and engaged with the adjustment screw, wherein:

the adjustable spanner further comprises two magnetic members mounted between the slideway of the main body and the movable jaw;

wherein the slideway of the main body has two opposite side walls and each wall has a respective one of the two magnetic members so that the movable jaw is maintained at the center of the slideway of the main body by the repulsive effect between the two magnetic members and the movable jaw without leaning on either one of the two opposite side walls of the slideway of the main body, so that the movable jaw is movable in the slideway of the main body smoothly and conveniently.

2. The adjustable spanner in accordance with claim 1, wherein the neck portion of the movable jaw is slidably mounted in the slideway of the main body and located between the two opposite side walls of the slideway of the main body.

3. The adjustable spanner in accordance with claim 1, wherein each of the two magnetic members is mounted in a respective one of the two opposite side walls of the slideway of the main body.

4. The adjustable spanner in accordance with claim 1, wherein each of the two magnetic members is mounted in a respective one of the two opposite side walls of the slideway of the main body in a bonding manner.

5. The adjustable spanner in accordance with claim 1, wherein each of the two magnetic members is mounted in a respective one of the two opposite side walls of the slideway of the main body in a close fit manner.

6. The adjustable spanner in accordance with claim 1, wherein the neck portion of the movable jaw has two sides each formed with a recess for mounting a respective one of the two magnetic members.

7. The adjustable spanner in accordance with claim 6, wherein each of the two magnetic members has a circular shape, and the recess of the neck portion of the movable jaw has a circular shape.

8. The adjustable spanner in accordance with claim 7, wherein each of the two magnetic members has a rectangular shape, and the recess of the neck portion of the movable jaw has a rectangular shape.

9. The adjustable spanner in accordance with claim 1, wherein the movable jaw has two sides each formed with a shoulder for mounting a respective one of the two magnetic members.

10. The adjustable spanner in accordance with claim 9, wherein the shoulder of the movable jaw is located above the neck portion.

11. The adjustable spanner in accordance with claim 9, wherein the slideway of the main body has two opposite side walls, and the shoulder of the movable jaw is located above each of the two opposite side walls of the slideway of the main body.

* * * * *